US006404118B1

(12) United States Patent
Park

(10) Patent No.: US 6,404,118 B1
(45) Date of Patent: Jun. 11, 2002

(54) DEFLECTION YOKE WITH A COIL SEPARATOR FIRMLY ENGAGED TO THE PRINTED CIRCUIT BOARD FOR PREVENTING FLUCTUATION

(75) Inventor: Byoung Jin Park, Kyungki-Do (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/803,587

(22) Filed: Mar. 9, 2001

(30) Foreign Application Priority Data

Dec. 9, 2000 (KR) ..... 2000-74925

(51) Int. Cl.[7] ..... H01J 29/70; H01J 29/82

(52) U.S. Cl. ..... 313/440; 313/410; 313/412; 313/442; 335/210; 335/212; 335/213; 335/214

(58) Field of Search ..... 313/440, 442, 313/410, 414, 412; 335/210–214; 348/829, 830; 439/547, 554, 567, 571

(56) References Cited

U.S. PATENT DOCUMENTS 4,096,531 A * 6/1978 Yamada et al. ..... 335/213
5,159,306 A * 10/1992 Rousseau ..... 335/210
5,745,348 A * 4/1998 Cha ..... 313/404
5,923,117 A * 7/1999 Azzi et al. ..... 313/433
6,198,368 B1 * 3/2001 Nam ..... 335/210

FOREIGN PATENT DOCUMENTS

JP 06060826 A * 3/1994 ..... H01J/29/76

* cited by examiner

*Primary Examiner*—Nimeshkumar D. Patel
*Assistant Examiner*—Sikha Roy
(74) *Attorney, Agent, or Firm*—Darby & Darby

(57) ABSTRACT

A deflection yoke for preventing fluctuation of the deflection yoke by maintaining a firmly engaged state while preventing fracture and damage thereof caused by an assembling shock generated when assembling a printed circuit board and a rear cover. The printed circuit board has upper hook flaps protruded from a side surface of the rear cover including a plurality of slide grooves and lower hook flaps provided on the side of the upper hooks for penetrating holes is provided, the hook flaps are composed of supporting ribs and protrusions. Especially, the protrusions of the upper hook flap have an inclined angle to assemble the printed circuit board that is combined the rear cover stably.

4 Claims, 7 Drawing Sheets

DEFLECTION YOKE WITH A COIL SEPARATOR FIRMLY ENGAGED TO THE PRINTED CIRCUIT BOARD FOR PREVENTING FLUCTUATION

BACKGROUND OF THE INVENTION

1. Field of the Invention

The present invention relates to a deflection yoke, and in particular, to a deflection yoke for preventing fluctuation of the deflection yoke by maintaining a firm engaged state while preventing fracture and damage thereof caused by an assembling shock generated when assembling the printed circuit board.

2. Description of the Prior Art

In general, a deflection yoke is employed for a TV set or a cathode ray tube (CRT) of a monitor to accurately deflect three-color beams scanned from an electron gun to a fluorescent screen coated on a screen of the CRT. The deflection yoke, which is the most significant factor of the magnetic devices of the CRT, plays a role of deflecting electron beams scanned from the electron gun so that the electric signals transmitted in time series can be reproduced as an image on the screen of the CRT.

To be specific, electron beams emitted from the electron gun travel straight forward the screen due to a high voltage, and illuminate a fluorescent body only at the center of the screen. Therefore, the deflection yoke plays a role of deflecting the electron beams so as to reach the screen in the order of being scanned from outside. This deflection yoke forms a magnetic field and uses a change of progressive direction by receiving power of the electron beams passing through the magnetic field so as to accurately deflect the electron beams to the coated fluorescent screen.

FIG. 1 is a side-elevational view of an ordinary CRT. As shown in FIG. 1, a deflection yoke 4 located at an RGB electron gun section 3 of a CRT 1 deflects electron beams scanned from an electron gun 3*a* to a fluorescent screen coated on a screen surface 2.

This deflection yoke 4 comprises a pair of coil separators 10 symmetrically coupled in upper and lower directions.

The coil separator 10 provided for insulating a horizontal deflection coil 15 and a vertical deflection coil 16 as well as for assembling the same at proper positions comprises a screen section 11*a* engaged with a screen surface of the CRT 1, a rear cover 11*b*, and a neck section 12 integrally elongated from the central surface of the rear cover 11*b* to be engaged with the electron gun section 3.

A horizontal deflection coil 15 and a vertical deflection coil 16 are provided on internal and outer peripheral surfaces of the coil separator 10 for forming a horizontal deflection magnetic field and a vertical deflection magnetic field with a power supply applied from outside.

A pair of ferrite cores 14 composed of a magnetic body are provided to surround the vertical deflection coil 16 for consolidating the vertical deflection magnetic field generated from the vertical deflection coil 16.

When a sawtooth pulse is applied to the horizontal deflection coil 15 and the vertical deflection coil 16, the deflection yoke 4 comprised as above determines a scanning position on the screen by deflecting the electron beams of red (R), green (G) and blue (B) emitted from the electron gun 3*a* of the CRT due to a magnetic field generated according to the Fleming's left-hand rule.

Meanwhile, the deflection yoke as shown in FIG. 1 is roughly classified into a saddle-saddle type deflection yoke as shown in FIGS. 2 and 3, and a saddle-toroidal type deflection yoke as shown in FIGS. 4 and 5 in accordance with a winding structure of the coil.

In the saddle-saddle type deflection yoke shown in FIGS. 2 and 3, the horizontal deflection coil 15 of a saddle shape is installed on upper and lower sides of the internal periphery of the screen section of the coil separator 10 of a cone shape.

To reinforce the magnetic field of the vertical deflection coil 16, the ferrite cores 14 of a cylindrical shape are provided on an external surface of the screen section 11*a* of the coil separator 10.

A coma-free coil (not shown in the drawings) is installed around an external periphery of the neck section 12 of the coil separator 10 for correcting coma generated by the vertical deflection coil 16.

FIGS. 4 and 5 are views showing an ordinary deflection yoke of a saddle-toroidal type. A horizontal deflection coil is installed on upper and lower sides of the internal peripheral surface of the screen section 11*a* of the coil separator 10 of a cone shape, and the ferrite cores 14 of a cylindrical shape are provided on an outer peripheral surface of the screen section 11*a*. A vertical deflection coil 16 of a toroidal type is wound along the upper and lower sides of the ferrite cores 14.

A coma-free coil (not shown in the drawings) is additionally installed around the periphery of the neck section 12 of the coil separator 10 for correcting coma generated by the vertical deflection coil 16.

In the saddle-saddle type deflection yoke and the saddle-toroidal type deflection yoke, a printed circuit board is additionally installed on one side surface of the coil separator 10 for supplying power to the aforementioned horizontal deflection coil 15 and the vertical deflection coil 16.

FIGS. 6 and 7 are views illustrating assembled states of the printed circuit board in the conventional deflection yoke. As shown in FIGS. 6 and 7, a printed circuit board 100 is engaged with a side surface of the rear cover 11*b* of the coil separator 10 for electrically connect the deflection coils and diverse electric automotive equipments.

A plurality of penetrating holes 110 are formed at predetermined positions of the printed circuit board 100 with regular intervals. A pair of hook flaps 200 are protruded from the rear cover lib corresponding to the penetrating holes 110 for fixing the printed circuit board 100 without fluctuation.

Here, in the pair of hook flaps 200, protrusions 210 having a triangular flap shape, i.e., slopes extended from a front end to a rear end thereof, are formed at end portions thereof so as to be suspended on one side surface of the printed circuit board 100 upon penetration of the penetrating holes 110.

The pair of hook flaps 200 are distanced to be slightly farther than the distance between the pair of penetrating holes 110 so that one surface perpendicular to the protrusions 210, i.e., the suspending threshold can support one side surface of the printed circuit board 100 after being elastically inserted to the penetrating holes 110.

Supporting ribs 220 are elongated to the hook flaps 200 so that the protrusions 210 penetrating the penetrating holes 110 press one side surface of the printed circuit board 100 when in contact with the other side surface of the printed circuit board 100.

The supporting ribs 220 having a predetermined area in a board plank shape is provided to extensively support one side surface of the printed circuit board.

In other words, the protrusions 210 integrally formed with the hook flaps 200 and the supporting ribs 220 fix the printed circuit board 100 by being in contact with the respective sides of the printed circuit board 100.

In the conventional deflection yoke having the above construction, the printed circuit board 100 is fixed onto the coil separator 100, i.e., on the rear cover 11*b*, by being suspended by the hook flaps 200 integrally protruded from the rear cover 11*b* and by being supported by the supporting ribs 220 elongated to the hook flaps 200.

However, such a conventional deflection yoke poses the following problems as the assembling structure between the printed circuit board 100 and the rear cover 11*b* is made by the pair of hook flaps 200 and the penetrating holes 110.

To be specific, as shown in FIG. 7, a worker needs to forcibly insert the printed circuit board 100 to the hook flaps 200 in order to fix the printed circuit board 100 onto the rear cover 11*b*. In this process, the assembling force laid on the printed circuit board 100 by the worker causes a fracture of the printed circuit board 100 or a deformation of the hook flaps 200.

Moreover, the printed circuit board 100 and the rear cover 11*b* have a structure of being engaged by the pair of penetrating holes 110 and the hook flaps 200. Therefore, if a forming dispersion or an assembling dispersion is generated in the penetrating holes 110 and the hook flaps 200, the printed circuit board 100 is not stably fixed on the rear cover 11*b* but is fluctuated.

The above problems not only increase defective proportion of the products but also notably deteriorate the quality of products due to failure of firmly fixing the printed circuit board 100 onto the rear cover 11*b*.

SUMMARY OF THE INVENTION

It is, therefore, an object of the present invention to provide a deflection yoke which can maintain a firm engaged state while reducing fracture and damage of the parts caused by an assembling force laid by a worker when fixing a printed circuit board onto a rear cover.

To achieve the above object, there is provided a deflection yoke, comprising: a coil separator including a screen section engaged with a screen surface of a CRT, a rear cover, and a neck section elongated from a central surface of the rear cover to be engaged with an electron gun section of the CRT; horizontal and vertical deflection coils provided on internal and outer peripheral surfaces of the coil separator for forming horizontal and vertical deflection magnetic fields; a printed circuit board engaged with the rear cover of the coil separator and having a plurality of slide grooves connected to a frame on an upper portion thereof and a plurality of penetrating holes formed beneath the slide grooves at regular intervals for electrically connecting each of electronic parts; upper hook flaps protruded from a side surface of the rear cover to have supporting ribs contacted with one surface of the printed circuit board at one end thereof and protrusions contacted with the other surface of the printed circuit board upon penetration of the slide grooves at the other end thereof; a lower hook flap provided on one side of the upper hook flap to have supporting ribs and protrusions for supporting both side surfaces of the printed circuit board by penetrating the same; and a guiding slope surface formed on the sides of the supporting ribs or protrusions to have a predetermined angle so that the printed circuit board can enter the space between the supporting ribs and the protrusions of the upper hook flaps with a predetermined angle.

The guiding slope surface according to the present invention is characterized by being formed on a side of the protrusions facing the supporting ribs of the upper hook flaps.

The guiding slope surface according to the present invention is further characterized by being formed on a side of the supporting ribs facing the protrusions of the upper hook flaps.

The guiding slope surface according to the present invention is also characterized by being formed within an angle range of 5–60°.

BRIEF DESCRIPTION OF THE DRAWINGS

The above objects, features and advantages of the present invention will become more apparent from the following detailed description when taken in conjunction with the accompanying drawings, in which.

DESCRIPTION OF THE PREFERRED EMBODIMENTS

Figure 1:
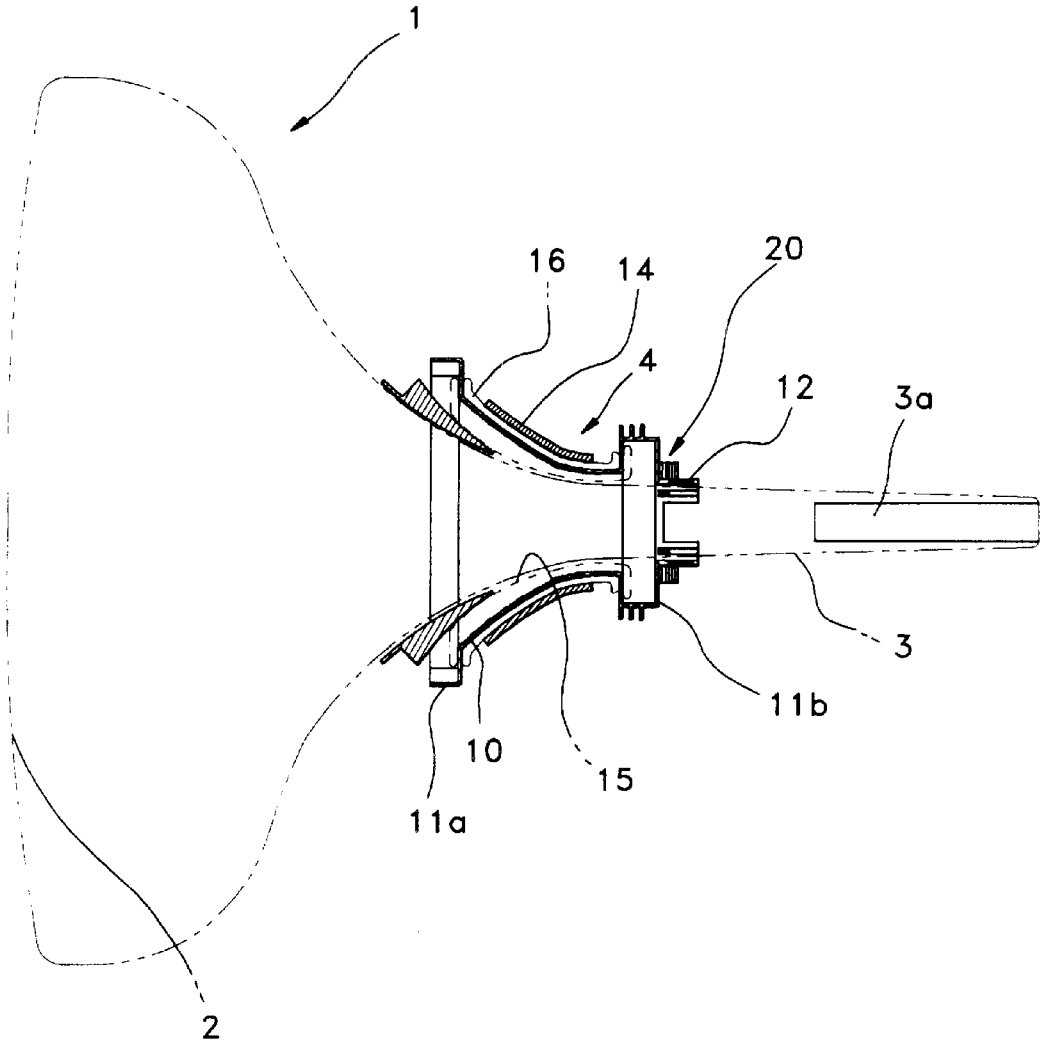
FIG. 1 (CONVENTIONAL ART)
FIG. 1 is a side-elevational view of a CRT in general.

Preferred embodiments of the present invention will now be described with reference to the accompanying drawings. In the following description, same drawing reference numerals are used for the same elements even in different drawings. The matters defined in the description such as a detailed construction and elements of a circuit are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Figure 2:
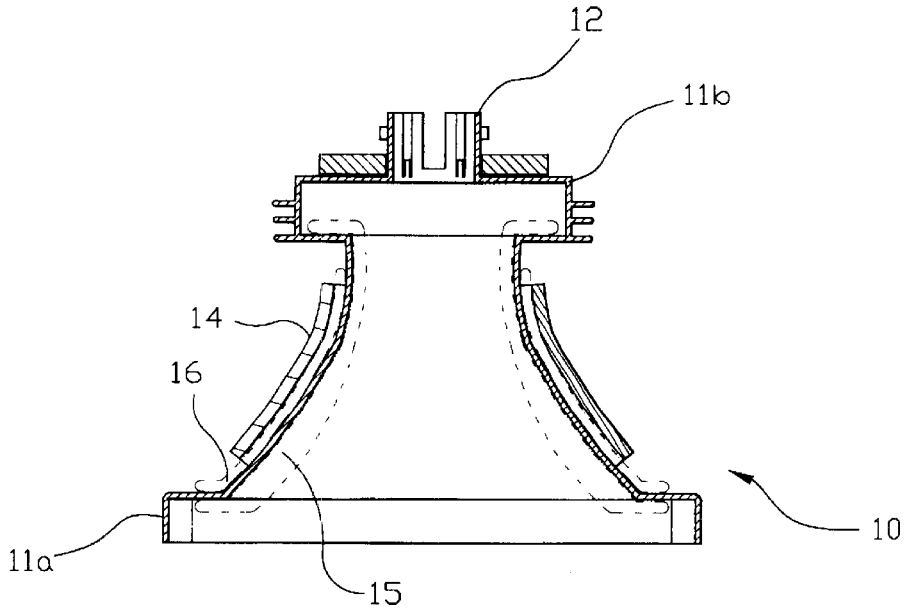
FIG. 2 (CONVENTIONAL ART)
FIG. 2 is a front view of a deflection yoke of a saddle-saddle type in general.
Figure 3:
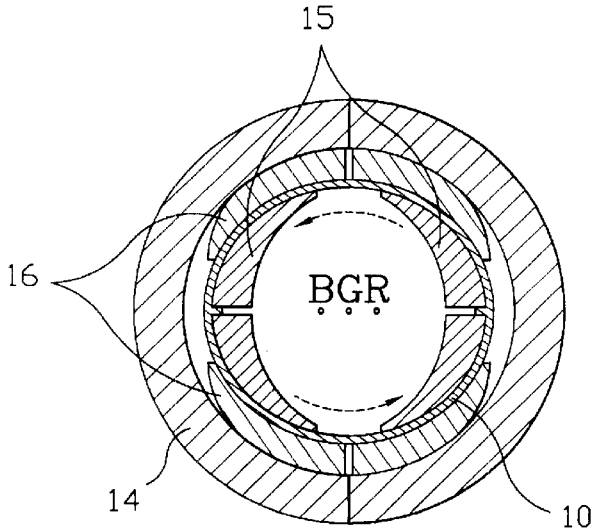
FIG. 3 (CONVENTIONAL ART)
FIG. 3 is a top-plan view of a deflection yoke of a saddle-saddle type in general.
Figure 4:
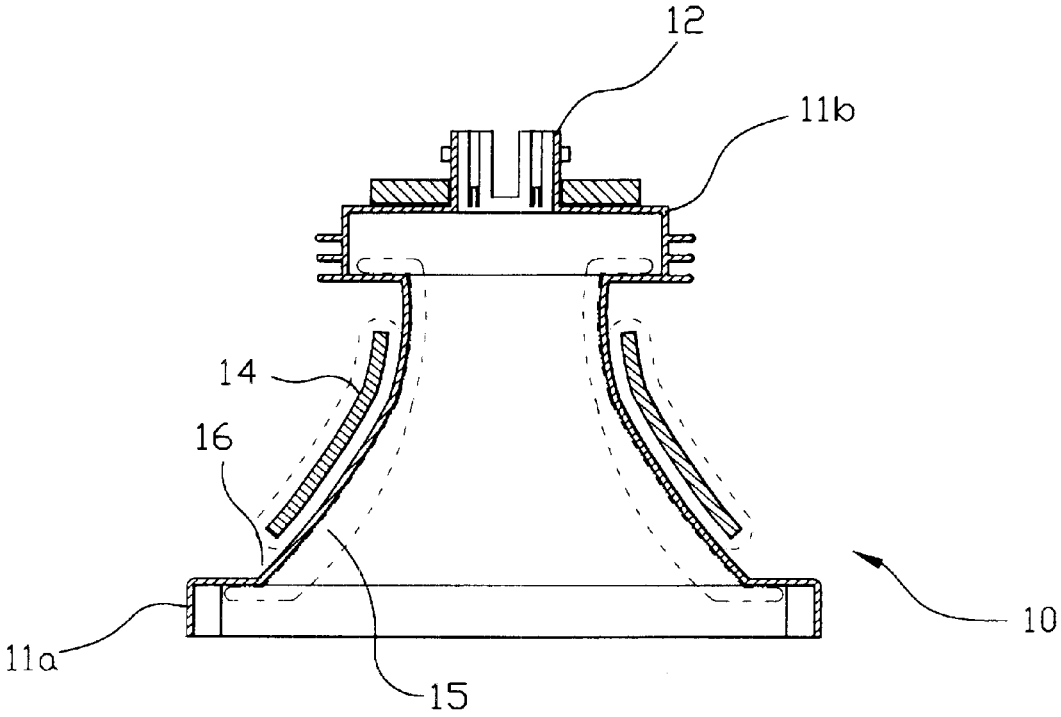
FIG. 4 (CONVENTIONAL ART)
FIG. 4 is a front view of an ordinary saddle-toroidal type deflection yoke.
Figure 5:
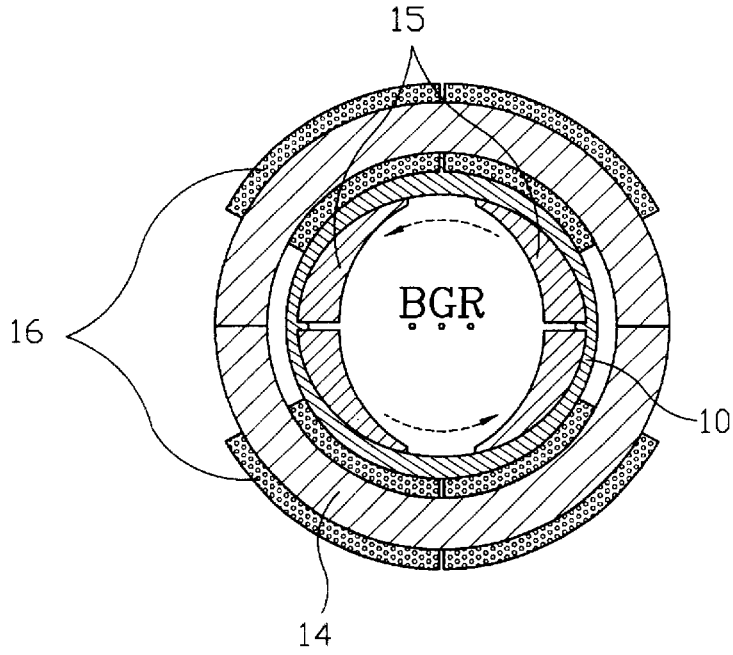
FIG. 5 (CONVENTIONAL ART)
FIG. 5 is a top-plan view of an ordinary saddle-toroidal type deflection yoke.
Figure 6:
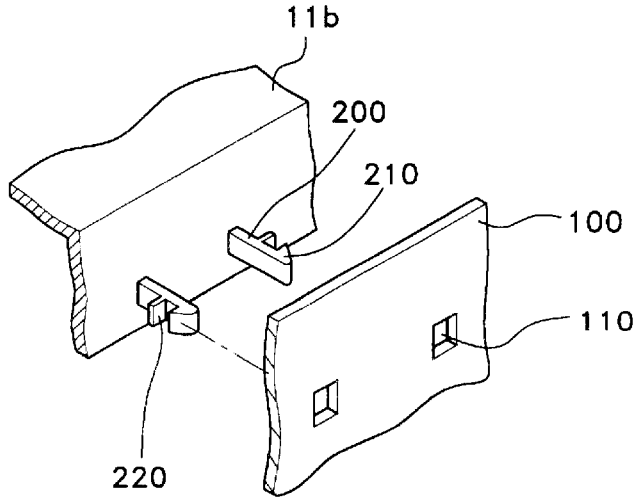
FIG. 6 (CONVENTIONAL ART)
FIGS. 6 and 7 are views illustrating assembled states of a printed circuit board in a conventional deflection yoke.
Figure 7:
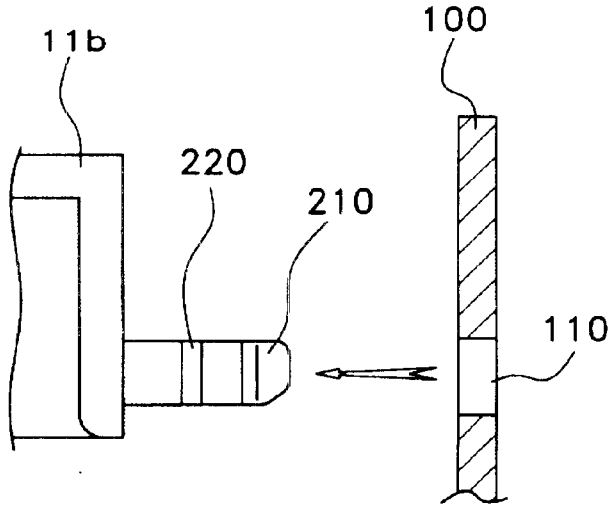

Referring to FIGS. 1 to 5, the ordinary deflection yoke 4 shown in FIG. 1 is located at the RGB electron gun section 3 of the CRT 1 for deflecting electron beams scanned from the electron gun 3*a* to a fluorescent screen coated on the screen surface 2. In accordance with the winding structure of a coil, deflection yokes are roughly classified into a saddle-saddle type deflection yoke as shown in FIGS. 2 and 3, and a saddle-toroidal type deflection yoke as shown in FIGS. 4 and 5.

The deflection yoke 4 plays a role of deflecting electron beams emitted from the electron gun 3*a* of R, G, B installed inside of the neck section 12 of the CRT 1 toward left, right, upper and lower directions so as to be collided with an accurate position on the fluorescent surface of the CRT.

FIGS. 2 and 3 are views of a saddle-saddle type deflection yoke. As shown in FIGS. 2 and 3, the horizontal deflection coil 15 of a saddle-saddle type is installed on upper/lower sides of inner peripheral surface of the screen section 11*a* of the coil separator 10 of a cone shape, while the vertical deflection coil 16 of a saddle-saddle type is installed on left/right sides of the outer peripheral surface.

To reinforce magnetic field of the vertical deflection coil 16, the ferrite cores 14 of a cylindrical shape are provided on an outer peripheral surface of the screen section 11*a* of the coil separator 10.

A coma-free coil (not shown in the drawings) is installed around an external periphery of the neck section 12 of the coil separator 10 to correct coma generated by the vertical deflection coil 16.

FIGS. 4 and 5 are views of an ordinary saddle-toroidal type deflection yoke. The horizontal deflection coil 15 is installed on upper and lower sides of the inner peripheral surface of the screen section 11*a* of the coil separator 10 of a cone shape. The ferrite cores 14 of a cylindrical shape are provided on an outer peripheral surface of the screen section 11*a*. The vertical deflection coil 16 of a toroidal type is wound along the upper and lower sides of the ferrite cores 14.

A coma-free coil (not shown in the drawings) is additionally installed around the external periphery of the neck section 12 of the coil separator 10 to correct coma generated by the vertical deflection coil 16.

In the deflection yokes of a saddle-saddle type and a saddle-toroidal type, a printed circuit board is installed on one side surface of the coil separator 10 for supplying power to the aforementioned horizontal deflection coil 15 and the vertical deflection coil 16.

Meanwhile, as shown in FIGS. 8 to 12, the horizontal deflection coil 15, the vertical deflection coil 16, and the printed circuit board 30 for electrically connecting diverse electric automotive products are engaged with a side surface of the rear cover 11*b* of the coil separator 10. The printed circuit board 30 is constructed so as to receive a power supply from outside.

Figure 8:
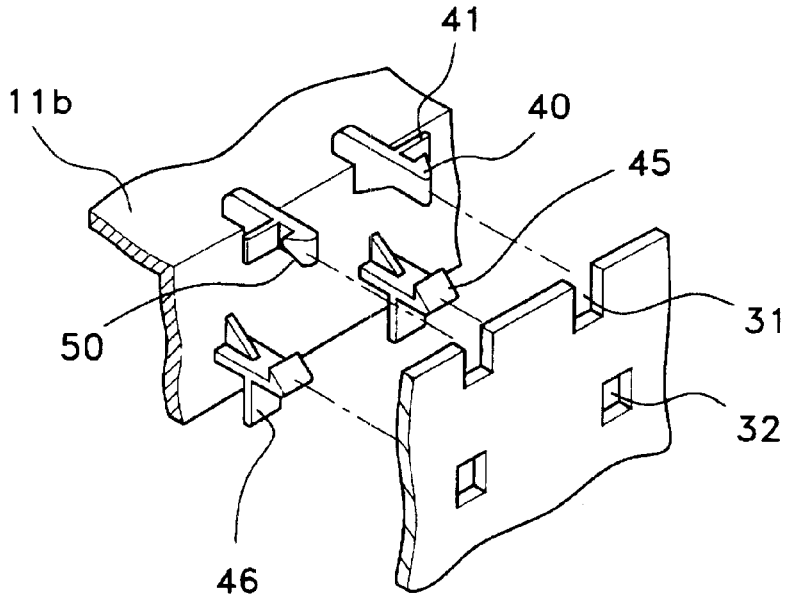
FIG. 8 is a view illustrating an assembled state of a printed circuit board in a deflection yoke according to an embodiment of the present invention.

The printed circuit board 30 engaged with the rear cover 11*b* of the coil separator 10 has a plurality of slide grooves 31 at regular intervals on both side surfaces of an upper portion thereof as shown in FIG. 8.

The slide grooves 31 are a kind of slits elongated from an upper frame toward a lower side of the printed circuit board 30 as shown in FIG. 8. According to the present invention, a pair of slide grooves are provided on an upper side of the printed circuit board 30 at regular intervals.

In the printed circuit board 30, a pair of penetrating holes 32 are formed on a lower side of the slide grooves 31.

The upper hook flaps 40 and the lower hook flap 45 are provided on the rear cover 11*b* corresponding to the slide grooves 31 and the penetrating holes 32 formed on the printed circuit board 30 to firmly fix the printed circuit board 30.

Here, the upper hook flaps 40 are formed in a pair on a side surface of the rear cover 11*b* corresponding to the slide grooves 31 of the printed circuit board 30 so as to be inserted to the pair of slide grooves 31.

In the upper hook flaps 200, protrusions having a triangular flap shape are formed at end portions thereof so as to be suspended upon penetration of the sliding grooves 31. Supporting ribs 41 are formed to be vertically elongated from the protrusions at predetermined positions with regular intervals.

The pair of hook flaps 40 are distanced to be slightly wider than the distance between the pair of slide grooves 31 so as to be elastically inserted to the slide grooves 31.

The supporting ribs 41 formed on the upper hook flaps 40 are extensively in contact with an area adjacent to the inner side of the printed circuit board 30 to prevent fluctuation of the printed circuit board 30 together with the protrusions, and have a board plank shape of being parallel with the ordinary printed circuit board 30.

The supporting ribs 41 are formed to have a board plank shape in a horizontal direction opposed to one end of the upper hook flaps 40 as shown in FIG. 8. However, the shape of the supporting ribs 41 is not limited to the board plank shape but may be variable provided that the structure of the shape can firmly support the other surface of the printed circuit board 30.

If the protrusions formed at the end portion of the upper hook flaps 40 penetrate the slide grooves 31, one side surface of the protrusions is in contact with one surface of the printed circuit board 30. At this stage, the supporting ribs 41 formed at regular intervals with the protrusions are in contact with the other surface of the printed circuit board 30.

The printed circuit board 30 is thus fixed onto the upper hook flaps 40 by a contact of the both side surfaces thereof centering around the slide grooves 31 with the supporting ribs 41 and the protrusions of the upper hook flaps 40.

Meanwhile, protrusions of a triangular flap shape are formed at an end portion of the lower hook flaps 45 formed on a lower side of the upper hook flaps 40, as in case of the upper hook flaps 40, and supporting ribs 46 are formed at regular intervals with the protrusions.

The lower hook flaps 45 are distanced slightly farther than the distance between the pair of penetrating holes 32 formed on a printed circuit board 30 so as to be elastically inserted to the penetrating holes 32.

The supporting ribs 46 formed on the lower hook flaps 45 are extensively in contact with an area adjacent to the inner side of the printed circuit board 30 to prevent fluctuation of the printed circuit board 30 together with the protrusions, and have a board plank shape of being parallel with the ordinary printed circuit board 30.

The supporting ribs 46 are formed to have a board plank shape in a horizontal direction opposed to one end of the pair of lower hook flaps 45 as shown in FIG. 8. However, the shape of the supporting ribs 46 is not limited to the board plank shape but may be variable provided that the structure of the shape can firmly support the other surface of the printed circuit board 30.

If the lower hook flaps 45 constructed as above penetrate the penetrating holes 32 of the printed circuit board 30, one surface of the protrusions is in contact with one surface of the printed circuit board 30, while the supporting ribs 46 are in contact with the other surface the printed circuit board 30.

Thus, the printed circuit board 30 is fixed onto the lower hook flaps 45 by a contact of both side surfaces thereof centering around the penetrating holes 32 with the supporting ribs 46 and the protrusions of the lower hook flaps 45.

The upper hook flaps 40 and the lower hook flaps 45 are respectively inserted to the slide grooves 31 and the penetrating holes 32 formed on the printed circuit board 30 so as to firmly fix the printed circuit board 30.

Figure 9:
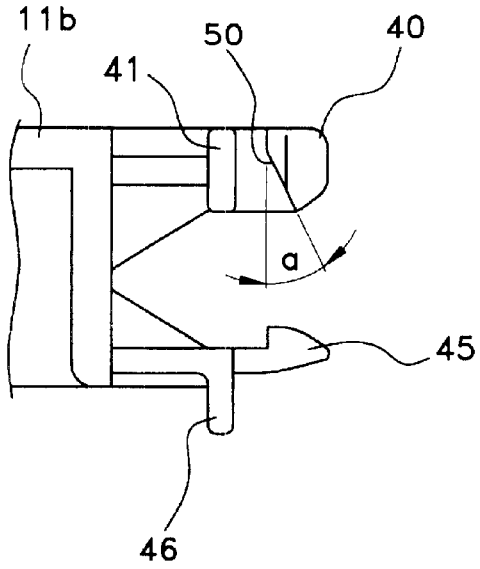
FIG. 9 is a side-elevational view of a rear cover in FIG. 8.

Meanwhile, to facilitate assembly of the printed circuit board 30, a guiding slope surface 50 having a slope angle ranged about 5–60° is formed on one side of the protrusions as shown in FIG. 9.

Figure 10:
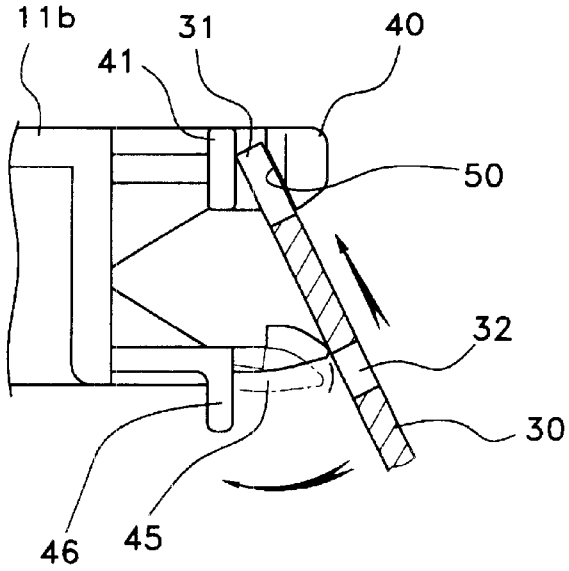
FIG. 10 is a side-elevational view of a printed circuit board as being assembled in FIG. 8.

This means that the guiding slope surface 50 formed on one side of the protrusions of the upper hook flaps 40 allows the printed circuit board 30 to enter the cleavage between the protrusions and the supporting ribs 41 of the upper hook flaps 40 with a predetermined angle as shown in FIG. 10.

Figure 12:
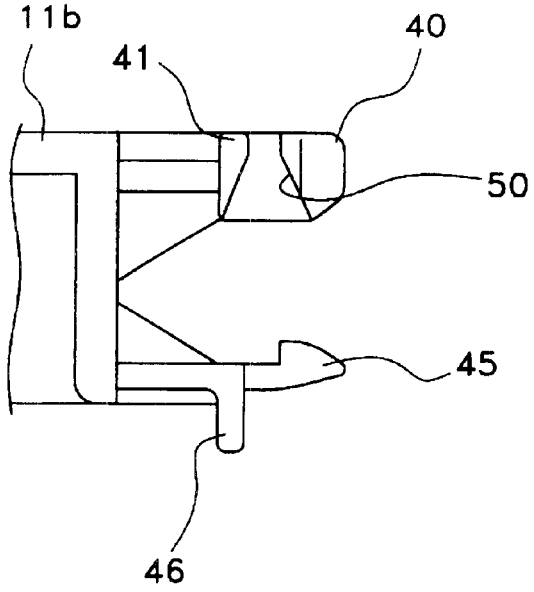
FIG. 12 is a side-elevational view of a rear cover according to another embodiment of the present invention in FIG. 9.

The guiding slope surface 50 can not only be formed on the protrusions of the upper hook flaps 40 but also may be formed on a side surface of the supporting ribs 41 facing the protrusions of the upper hook flaps 40 as shown in FIG. 12.

An assembling process of the printed circuit board in a deflection yoke according to the present invention will now be described.

In order to fix the printed circuit board 30 onto the rear cover 11*b*, an upper portion of the printed circuit board 30 shown in FIG. 10, i.e., the pair of slide grooves 31, are inserted to the pair of upper hook flaps 40 formed on a side surface of the rear cover 11*b*.

Since the guiding slope surface 50 having a slope surface of a predetermined angle is formed on the protrusions of the pair of upper hook flaps 40, the slide grooves 31 can be easily inserted along one end of the upper hook flaps 40 with no difficulty if the printed circuit board 30 inserted between the protrusions and the supporting ribs 41 of the upper hook flaps 40 is inclined with an entry angle, i.e., with an angle inclined for assembly.

Subsequently, if the slide grooves 31 of the printed circuit board 30 are suspended between the protrusions and the supporting ribs 41 of the upper hook flaps 40, the lower side of the printed circuit board 30 is moved toward the lower hook flaps 45 centering around the suspended part, i.e., centering around the upper hook flaps 40 and the slide grooves 31.

Figure 11:
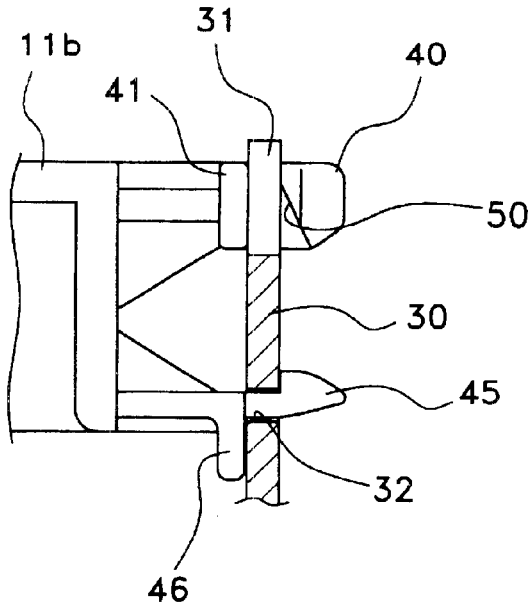
FIG. 11 is a side-elevational view of an assembled printed circuit board in FIG. 10.

Then, the penetrating holes 32 of the printed circuit board 30 approach the lower hook flaps 45, and the lower hook flaps 45 cause a slightly elastic displacement along the slope surface of the printed circuit board 30 so that the lower hook flaps 45 can be inserted to the penetrating holes 32 as shown in FIG. 11. At the same time, the slide grooves 31 are completely inserted and fixed onto the upper hook flaps 40.

Accordingly, fracture of the printed circuit board 30 can be prevented in advance as the shocking force and external force generated during an assembly are reduced because the penetrating holes 32 are fixed onto the lower hook flaps 45 under the state that the printed circuit board 30 is inclined and the upper hook flaps 40 having the guiding slope surface 50 have entered the slide grooves 31.

The assembling efficiency of the printed circuit board 30 thus being drastically improved, productivity of the printed circuit board 30 can also be enhanced, and a low quality of the product caused by fracture of the printed circuit board and the hook flaps in the assembling process can be prevented in advance.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A deflection yoke comprising:

a coil separator including a screen section engaged with a screen surface of a CRT, a rear cover, and a neck section elongated from a central surface of the rear cover to be engaged with an electron gun section of the CRT;

horizontal and vertical deflection coils provided on inner and outer peripheral surfaces of the coil separator for forming horizontal and vertical deflection magnetic fields;

a printed circuit board engaged with the rear cover of the coil separator to have a plurality of slide grooves connected to a frame on an upper portion thereof, and a plurality of penetrating holes formed on a lower side of the slide grooves at predetermined intervals for electrically connect each of electronic parts;

upper hook flaps protruded from a side surface of the rear cover and have supporting ribs contacted with one surface of the printed circuit board at one end thereof and protrusions contacted with the other surface of the printed circuit board at the other end thereof upon penetration of the slide grooves;

lower hook flaps provided on one side of the upper hooks for penetrating the penetrating holes of the printed circuit board to support both side surfaces thereof; and a guiding slope surface formed on the side of the supporting ribs or the protrusions with a predetermined angle so as the printed circuit board can enter the space between the supporting ribs and the protrusions of the upper hook flaps with an inclined angle.

2. The deflection yoke of claim 1, wherein the guiding slope surface is formed on the side of the protrusions facing the supporting ribs.

3. The deflection yoke of claim 1, wherein the guiding slope surface is formed on the side of the supporting ribs facing the protrusions of the upper hook flaps.

4. The deflection yoke of claim 1, wherein the guiding slope surface has an angle ranged 5–60°.

* * * * *